US011694635B2

(12) United States Patent
Park et al.

(10) Patent No.: US 11,694,635 B2
(45) Date of Patent: *Jul. 4, 2023

(54) METHOD OF DRIVING DISPLAY PANEL INCLUDING COMPENSATING FOR FLICKER AND DISPLAY APPARATUS FOR PERFORMING THE SAME

(71) Applicant: Samsung Display Co., Ltd., Yongin-Si (KR)

(72) Inventors: Sehyuk Park, Seongnam-si (KR); Sangan Kwon, Cheonan-si (KR); HongSoo Kim, Hwaseong-si (KR); Jinyoung Roh, Hwaseong-si (KR); Hyo Jin Lee, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 17/586,470

(22) Filed: Jan. 27, 2022

(65) Prior Publication Data

US 2022/0148524 A1 May 12, 2022

Related U.S. Application Data

(63) Continuation of application No. 16/920,322, filed on Jul. 2, 2020, now Pat. No. 11,244,633.

(30) Foreign Application Priority Data

Jul. 18, 2019 (KR) ..... KR10-2019-0087189

(51) Int. Cl.
*G09G 3/3291* (2016.01)

(52) U.S. Cl.
CPC ..... *G09G 3/3291* (2013.01); *G09G 2320/02* (2013.01); *G09G 2330/021* (2013.01)

(58) Field of Classification Search
CPC ..... G09G 3/3291
(Continued)

(56) References Cited

U.S. PATENT DOCUMENTS

2009/0207193 A1 8/2009 Isobe et al.
2009/0303171 A1* 12/2009 Chang ..... G09G 3/3426 315/297

(Continued)

FOREIGN PATENT DOCUMENTS

KR 10-1030544 B1 4/2011
KR 10-2015-0057851 A 5/2015

(Continued)

OTHER PUBLICATIONS

Office Action in connection with U.S. Appl. No. 16/931,509 dated Jul. 6, 2020, 21 pages.

*Primary Examiner* — Long D Pham
(74) *Attorney, Agent, or Firm* — Innovation Counsel LLP

(57) ABSTRACT

A method of driving a display panel includes dividing an input image into a plurality of segments, generating a flicker value of a segment of the plurality of segments, determining whether to compensate the flicker value of the segment or not according to a segment size, compensating the flicker value of the segment based on the segment size, determining a frame rate of the display panel based on the flicker value of the segment and outputting a data voltage to the display panel in the frame rate. The flicker value of the segment is compensated based on the flicker value of the segment and flicker values of segments that are adjacent to the segment.

20 Claims, 16 Drawing Sheets

(58) Field of Classification Search
USPC ..... 345/89
See application file for complete search history.

(56) References Cited

U.S. PATENT DOCUMENTS

| | | | | |
|---|---|---|---|---|
| 2010/0020112 | A1 | 1/2010 | Jeon et al. | |
| 2010/0085341 | A1 | 4/2010 | Hasegawa et al. | |
| 2010/0103202 | A1 | 4/2010 | Seo et al. | |
| 2010/0110111 | A1* | 5/2010 | Kim | G09G 3/3426 315/297 |
| 2010/0149167 | A1 | 6/2010 | Hasegawa et al. | |
| 2010/0245397 | A1* | 9/2010 | Choe | G09G 3/342 345/690 |
| 2015/0340014 | A1 | 11/2015 | Kim et al. | |
| 2017/0011692 | A1 | 1/2017 | Lee et al. | |
| 2017/0018234 | A1 | 1/2017 | Na et al. | |
| 2017/0132964 | A1 | 5/2017 | Lee et al. | |

FOREIGN PATENT DOCUMENTS

| | | | |
|---|---|---|---|
| KR | 10-2015-0094881 | A | 8/2015 |
| KR | 10-1544843 | B1 | 8/2015 |
| KR | 10-2016-0011818 | A | 2/2016 |
| KR | 10-2017-0010175 | A | 1/2017 |
| KR | 10-20189-0032256 | A | 3/2018 |

* cited by examiner

FIG. 4

| | | | | | | | | | |
|---|---|---|---|---|---|---|---|---|---|
| S1 | S2 | S3 | S4 | S5 | S6 | S7 | S8 | S9 | S10 |
| S11 | S12 | S13 | S14 | S15 | S16 | S17 | S18 | S19 | S20 |
| S21 | S22 | S23 | S24 | S25 | S26 | S27 | S28 | S29 | S30 |
| S31 | S32 | S33 | S34 | S35 | S36 | S37 | S38 | S39 | S40 |
| S41 | S42 | S43 | S44 | S45 | S46 | S47 | S48 | S49 | S50 |
| S51 | S52 | S53 | S54 | S55 | S56 | S57 | S58 | S59 | S60 |
| S61 | S62 | S63 | S64 | S65 | S66 | S67 | S68 | S69 | S70 |
| S71 | S72 | S73 | S74 | S75 | S76 | S77 | S78 | S79 | S80 |
| S81 | S82 | S83 | S84 | S85 | S86 | S87 | S88 | S89 | S90 |
| S91 | S92 | S93 | S94 | S95 | S96 | S97 | S98 | S99 | S100 |

| | | | | | | | | | |
|---|---|---|---|---|---|---|---|---|---|
| S1 | S2 | S3 | S4 | S5 | S6 | S7 | S8 | S9 | S10 |
| S11 | S12 | S13 | S14 | S15 | S16 | S17 | S18 | S19 | S20 |
| S21 | S22 | S23 | S24 | S25 | S26 | S27 | S28 | S29 | S30 |
| S31 | S32 | S33 | S34 | S35 | S36 | S37 | S38 | S39 | S40 |
| S41 | S42 | S43 | S44 | S45 | S46 | S47 | S48 | S49 | S50 |
| S51 | S52 | S53 | S54 | S55 | S56 | S57 | S58 | S59 | S60 |
| S61 | S62 | S63 | S64 | S65 | S66 | S67 | S68 | S69 | S70 |
| S71 | S72 | S73 | S74 | S75 | S76 | S77 | S78 | S79 | S80 |
| S81 | S82 | S83 | S84 | S85 | S86 | S87 | S88 | S89 | S90 |
| S91 | S92 | S93 | S94 | S95 | S96 | S97 | S98 | S99 | S100 |

| | | | | | | | | | |
|---|---|---|---|---|---|---|---|---|---|
| S1 | S2 | S3 | S4 | S5 | S6 | S7 | S8 | S9 | S10 |
| S11 | S12 | S13 | S14 | S15 | S16 | S17 | S18 | S19 | S20 |
| S21 | S22 | S23 | S24 | S25 | S26 | S27 | S28 | S29 | S30 |
| S31 | S32 | S33 | S34 | S35 | S36 | S37 | S38 | S39 | S40 |
| S41 | S42 | ~~S43~~ | S44 | S45 | S46 | S47 | S48 | S49 | S50 |
| S51 | S52 | S53 | S54 | S55 | S56 | S57 | S58 | S59 | S60 |
| S61 | S62 | S63 | S64 | S65 | S66 | S67 | S68 | S69 | S70 |
| S71 | S72 | S73 | S74 | S75 | S76 | S77 | S78 | S79 | S80 |
| S81 | S82 | S83 | S84 | S85 | S86 | S87 | S88 | S89 | S90 |
| S91 | S92 | S93 | S94 | S95 | S96 | S97 | S98 | S99 | S100 |

| | | | | | | | | | |
|---|---|---|---|---|---|---|---|---|---|
| S1 | S2 | S3 | S4 | S5 | S6 | S7 | S8 | S9 | S10 |
| S11 | S12 | S13 | S14 | S15 | S16 | S17 | S18 | S19 | S20 |
| S21 | S22 | S23 | S24 | S25 | S26 | S27 | S28 | S29 | S30 |
| S31 | S32 | S33 | S34 | S35 | S36 | S37 | S38 | S39 | S40 |
| S41 | S42 | S43 | S44 | S45 | S46 | S47 | S48 | S49 | S50 |
| S51 | S52 | S53 | S54 | S55 | S56 | S57 | S58 | S59 | S60 |
| S61 | S62 | S63 | S64 | S65 | S66 | S67 | S68 | S69 | S70 |
| S71 | S72 | S73 | S74 | S75 | S76 | S77 | S78 | S79 | S80 |
| S81 | S82 | S83 | S84 | S85 | S86 | S87 | S88 | S89 | S90 |
| S91 | S92 | S93 | S94 | S95 | S96 | S97 | S98 | S99 | S100 |

| | | | | | | | | | |
|---|---|---|---|---|---|---|---|---|---|
| S1 | S2 | S3 | S4 | S5 | S6 | S7 | S8 | S9 | S10 |
| S11 | S12 | S13 | S14 | S15 | S16 | S17 | S18 | S19 | S20 |
| S21 | S22 | S23 | S24 | S25 | S26 | S27 | S28 | S29 | S30 |
| S31 | S32 | S33 | S34 | S35 | S36 | S37 | S38 | S39 | S40 |
| S41 | S42 | ~~S43~~ | S44 | S45 | S46 | S47 | S48 | S49 | S50 |
| S51 | S52 | S53 | S54 | S55 | S56 | S57 | S58 | S59 | S60 |
| S61 | S62 | S63 | S64 | S65 | S66 | S67 | S68 | S69 | S70 |
| S71 | S72 | S73 | S74 | S75 | S76 | S77 | S78 | S79 | S80 |
| S81 | S82 | S83 | S84 | S85 | S86 | S87 | S88 | S89 | S90 |
| S91 | S92 | S93 | S94 | S95 | S96 | S97 | S98 | S99 | S100 |

FIG. 9B

| GRAYSCALE VALUE | FLICKER VALUE | FRAME RATE |
|---|---|---|
| 255 | 0 | 1Hz |
| 19 | 204 | 30Hz |

FIG. 9C

| FLICKER VALUE | FRAME RATE |
|---|---|
| 205-255 | 60Hz |
| 154-204 | 30Hz |
| 103-153 | 10Hz |
| 52-102 | 2Hz |
| 0-51 | 1Hz |

METHOD OF DRIVING DISPLAY PANEL INCLUDING COMPENSATING FOR FLICKER AND DISPLAY APPARATUS FOR PERFORMING THE SAME

PRIORITY STATEMENT

This application is a continuation of U.S. patent application Ser. No. 16/920,322 filed on Jul. 2, 2020, now U.S. Pat. No. 11,244,633,which claims priority under 35 U.S.C. § 119 to Korean Patent Application No. 10-2019-0087189, filed on Jul. 18, 2019, in the Korean Intellectual Property Office KIPO, the entire contents of which are herein incorporated by reference in their entireties.

BACKGROUND

1. Field

The technical field relates to a method of driving a display panel and a display apparatus for performing the method, such as, for example, a method of driving a display panel for reducing power consumption and enhancing display quality.

2. Description of the Related Art

Recently, methods to minimize power consumption of electronic device such as a tablet PCs and note PCs have been studied.

To minimize the power consumption of electronic devices including a display panel, power consumption of the display panel may be minimized. That is, when the display panel displays a static image, the display panel may be driven in a relatively low frequency so that a power consumption of the display panel may be reduced.

When the display panel is driven in this relatively low frequency, a flicker may be generated that degrades the display quality.

SUMMARY

Example embodiments of the present inventive concept provide a method of driving a display panel capable of reducing a power consumption and enhancing a display quality.

Example embodiments of the present inventive concept also provide a display apparatus for performing the above-mentioned method.

In an example embodiment of a method of driving a display panel according to the present inventive concept, the method includes dividing an input image into a plurality of segments, generating a flicker value of a segment of the plurality of segments, compensating the flicker value of the segment based on segment size, flicker value of the segment, and flicker values of neighboring segments positioned around the segment; determining a frame rate of the display panel based on the flicker value of the segment and outputting a data voltage to the display panel in the frame rate.

In an example embodiment, wherein the compensating the flicker value of the segment or not may include determining not to compensate the flicker value of the segment when the segment size is equal to or greater than a compensation threshold and determining to compensate the flicker value of the segment when the segment size is less than the compensation threshold.

In an example embodiment, the method may further include determining a compensation size, wherein the compensation size represents a number of a flicker value of a compensation target segment and flicker values of segments adjacent to the compensation target segment; and wherein the compensation size is used for compensation of the compensation target segment when the segment size is less than the compensation threshold.

In an example embodiment, the compensation size may be determined such that a multiplication of the segment size and the compensation size is equal to or greater than the compensation threshold.

In an example embodiment, the compensation size may be determined as a minimum integer satisfying that the multiplication of the segment size and the compensation size is equal to or greater than the compensation threshold.

In an example embodiment, the determining the compensation size may include determining a first compensation size representing a number of the flicker value of the compensation target segment and the flicker values of the segments adjacent to the compensation target segment in a first direction and determining a second compensation size representing a number of the flicker value of the compensation target segment and the flicker values of the segments adjacent to the compensation target segment in a second direction different from the first direction; wherein the first compensation size and the second compensation size are each used for compensation of the compensation target segment.

In an example embodiment, the method may further include determining a compensation size. The compensation size may be determined by dividing the compensation threshold by the segment size. The determining whether or not to compensate the flicker value of the segment may include determining not to compensate the flicker value of the segment when the segment size is equal to or less than 1 and determining to compensate the flicker value of the segment when the segment size is greater than 1.

In an example embodiment, the determining the compensation size may include determining a first compensation size representing a number of a flicker value of a compensation target segment and the flicker values of the segments adjacent to the compensation target segment in a first and determining a second compensation size representing a number of the flicker value of the compensation target segment and the flicker values of the segments adjacent to the compensation target segment in a second direction different from the first direction; wherein the first compensation size and the second compensation size are used for compensation of the compensation target segment.

In an example embodiment, the method may further include determining whether the input image represents a static image or a video image. The frame rate of the display panel may be determined based on the flicker value of the segment when the input image represents the static image.

In an example embodiment, the flicker value of the segment may include converting luminances of pixels into flicker values of the pixels and operating the flicker values of the pixels in the segments.

In an example embodiment, the operating the flicker values of the pixels in the segments may include summing the flicker values of the pixels in the segments.

In an example embodiment, the operating the flicker values of the pixels in the segments may include setting weights of the pixels based on positions of the pixels and operating a weighted sum of the flicker values of the pixels using the weights of the pixels.

In an example embodiment, the determining the frame rate of the display panel may include comparing a maximum value of the flicker values of the segments to a threshold.

In an example embodiment, the determining the frame rate of the display panel may include comparing an average of flicker values of segments that is greater than a predetermined flicker value to a threshold.

In an example embodiment of a display apparatus according to the present inventive concept, the display apparatus includes a display panel, a low frequency driver and a data driver.

The display panel is configured to display an image. The low frequency driver connected to the display panel and is configured to divide an input image into a plurality of segments, to generate a flicker value of a segment of the plurality of the segments, to determine whether or not to compensate the flicker value of the segment depending on the segment size, to compensate the flicker value of the segment based on the segment size and to determine a frame rate of the display panel based on the flicker value of the segment. The data driver connected to the display panel and is configured to output a data voltage to the display panel in the frame rate.

In an example embodiment, the low frequency driver may be configured to determine not to compensate the flicker value of the segment when the segment size is equal to or greater than a compensation threshold. The low frequency driver may be configured to determine to compensate the flicker value of the segment when the segment size is less than the compensation threshold.

In an example embodiment, the low frequency driver may be configured to determine a compensation size, the compensation size representing a number of a flicker value of a compensation target segment and flicker values of segments adjacent to the compensation target segment, the compensation size used for compensation of the compensation target segment when the segment size is less than the compensation threshold.

In an example embodiment, the compensation size may be determined such that a multiplication of the segment size and the compensation size is equal to or greater than the compensation threshold.

In an example embodiment, the low frequency driver may be configured to determine a compensation size. The compensation size may be determined based on a number of a flicker value of a compensation target segment and flicker values of segments adjacent to the compensation target segment, the compensation size used for compensation of the compensation target segment. The compensation size may be determined by dividing the compensation threshold by the segment size. The low frequency driver may be configured to determine not to compensate the flicker value of the segment when the segment size is equal to or less than 1. The low frequency driver may be configured to determine to compensate the flicker value of the segment when the segment size is greater than 1.

In an example embodiment, the low frequency driver may include a static image determiner configured to determine whether the input image represents a static image or a video image. The low frequency driver may be configured to determine the frame rate of the display panel based on the flicker value of the segment when the input image represents the static image.

According to the method of driving the display panel and the display apparatus for performing the display panel, the frame rate is determined according to an image displayed on the display panel so that a power consumption of the display apparatus may be reduced. In addition, the frame rate is determined using the flicker value of the segments of the image on the display panel so that a flicker of the image may be prevented and a display quality of the display panel may be enhanced. In addition, the flicker values of the segments are compensated using the flicker values of the adjacent segments so that the display quality of the display panel may be further enhanced.

BRIEF DESCRIPTION OF THE DRAWINGS

The above and other features and advantages of the present inventive concept will become more apparent by describing in detailed example embodiments thereof with reference to the accompanying drawings, in which:

FIG. 4 is a conceptual diagram illustrating segments defined by a segment determiner of FIG. 3;

FIGS. 9A, 9B, and 9C illustrate a method of compensating the flicker values of the segments without considering a segment size;

DETAILED DESCRIPTION OF THE INVENTIVE CONCEPT

Figure 1:
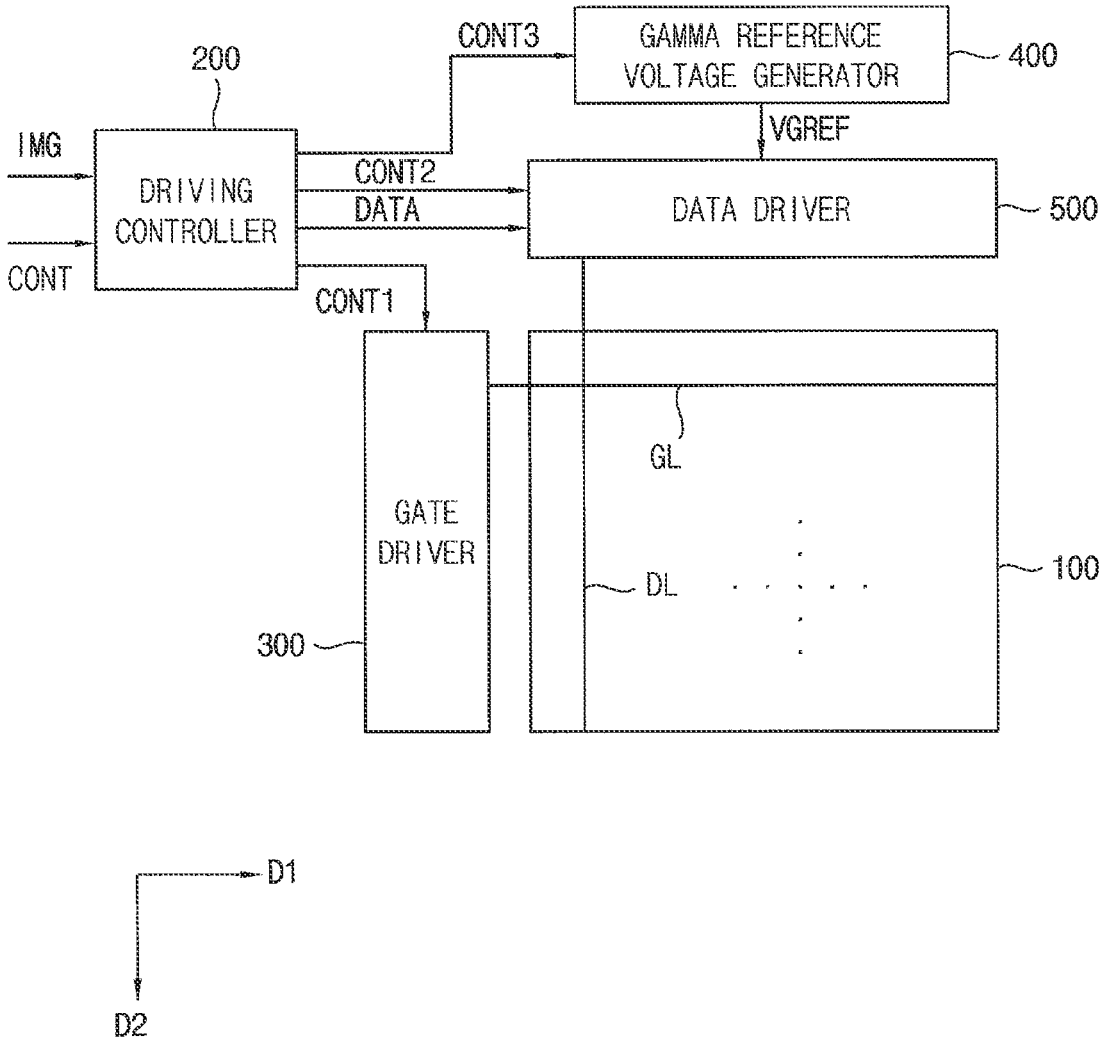
FIG. 1 is a block diagram illustrating a display apparatus according to an example embodiment of the present inventive concept.

Hereinafter, the present inventive concept will be explained in detail with reference to the accompanying drawings. Each of the components mentioned in this specification, including (but not limited to), for example, "generator", "driver", "converter", "determiner", "compensator", "controller", may be hardware components such as, for example, integrated circuits, microprocessors, and the like. Alternatively, at least some of these components may be implemented in software.

Example embodiments are described with reference to the accompanying drawings. The described embodiments may be modified in various ways, all without departing from the spirit or scope of the present disclosure.

In the present disclosure, like reference numerals may designate like elements.

In the drawings, dimensions of elements may be exaggerated for clarity.

Although the terms "first," "second," etc. may be used to describe various elements, these elements should not be limited by these terms. These terms may be used to distinguish one element from another element. A first element may be termed a second element without departing from teachings of one or more embodiments. The description of an element as a "first" element may not require or imply the presence of a second element or other elements. The terms "first," "second," etc. may be used to differentiate different categories or sets of elements. For conciseness, the terms "first," "second," etc. may represent "first-type (or first-set), " "second-type (or second-set)," etc., respectively.

When a first element is referred to as being "on" a second element, the first element can be directly on the second element, or one or more intervening elements may be present between the first element and the second element. When a first element is referred to as being "directly on" a second element, there are no intended intervening elements (except environmental elements such as air) present between the first element and the second element. When a first element is referred to as being "connected to" a second element, the first element can be directly connected (physically and/or electrically) and/or attached to the second element, or one or more intervening elements may be connected between the first element and the second element.

In the present specification, unless explicitly described to the contrary, the word "comprise" and variations such as "comprises" or "comprising" may imply the inclusion of stated elements but may not require the exclusion of any other elements.

The term "connect" may mean "electrically connect." The term "insulate" may mean "electrically insulate."

FIG. 1 is a block diagram illustrating a display apparatus according to an example embodiment of the present inventive concept.

Referring to FIG. 1, the display apparatus includes a display panel 100 and a display panel driver. The display panel driver includes a driving controller 200, a gate driver 300, a gamma reference voltage generator 400, and a data driver 500, each of which may be hardware components such as, for example, integrated circuits, microprocessors, and the like. In alternative embodiments, at least some of these components may be implemented in software.

In some example embodiments, the driving controller 200 and the data driver 500 may be integrally formed (e.g., formed as a single component). In some example embodiments, the driving controller 200, the gamma reference voltage generator 400 and the data driver 500 may be integrally formed. A driving module including at least the driving controller 200 and the data driver 500 which are integrally formed may be called to a timing controller embedded data driver (TED).

The display panel 100 has a display region on which an image is displayed and a peripheral region adjacent to the display region.

The display panel 100 includes a plurality of gate lines GL, a plurality of data lines DL and a plurality of pixels connected to the gate lines GL and the data lines DL. The gate lines GL extend in a first direction D1, and the data lines DL extend in a second direction D2 crossing the first direction D1.

The driving controller 200 receives input image data IMG and an input control signal CONT from an external apparatus (not shown). The input image data IMG may include red image data, green image data and blue image data. The input image data IMG may also include white image data. The input image data IMG may include magenta image data, yellow image data and cyan image data. The input control signal CONT may include a master clock signal and a data enable signal. The input control signal CONT may further include a vertical synchronizing signal and a horizontal synchronizing signal.

The driving controller 200 generates a first control signal CONT1, a second control signal CONT2, a third control signal CONT3, each based on the input control signal CONT. The driving controller 200 also generates a data signal DATA based on the input image data IMG.

The driving controller 200 generates the first control signal CONT1 based on the input control signal CONT, and outputs the first control signal CONT1 to the gate driver 300. The first control signal CONT1 may further include a vertical start signal and a gate clock signal. The first control signal CON is for controlling an operation of the gate driver 300.

The driving controller 200 generates the second control signal CONT2 based on the input control signal CONT, and outputs the second control signal CONT2 to the data driver 500. The second control signal CONT2 may include a horizontal start signal and a load signal. The second control signal CONT2 is for controlling an operation of the data driver 500.

The driving controller 200 generates the data signal DATA based on the input image data IMG. The driving controller 200 outputs the data signal DATA to the data driver 500.

In an example embodiment, the driving controller 200 may adjust a frame rate of the display panel 100 based on the input image data IMG.

The driving controller 200 generates the third control signal CONT3 based on the input control signal CONT, and outputs the third control signal CONT3 to the gamma reference voltage generator 400. The third control signal CONT3 is for controlling an operation of the gamma reference voltage generator 400.

Referring to FIGS. 2 to 10 in detail, a structure and an operation of the driving controller 200 are explained by.

The gate driver 300 generates gate signals driving the gate lines GL in response to the first control signal CONT1 received from the driving controller 200. The gate driver 300 outputs the gate signals to the gate lines GL. For example, the gate driver 300 may sequentially output the gate signals to the gate lines GL. The gate driver 300 may be mounted on the display panel 100, or the gate driver 300 may be integrated on the display panel 100.

The gamma reference voltage generator 400 generates a gamma reference voltage VGREF in response to the third control signal CONT3 received from the driving controller 200. The gamma reference voltage generator 400 provides the gamma reference voltage VGREF to the data driver 500. The gamma reference voltage VGREF has a value corresponding to a level of the data signal DATA.

In an example embodiment, the gamma reference voltage generator 400 may be disposed in the driving controller 200, or in the data driver 500.

The data driver 500 receives the second control signal CONT2 and the data signal DATA from the driving controller 200, and receives the gamma reference voltages VGREF from the gamma reference voltage generator 400. The data driver 500 converts the data signal DATA into data voltages having an analog type using the gamma reference voltages VGREF. The data driver 500 outputs the data voltages to the data lines DL.

Figure 2:
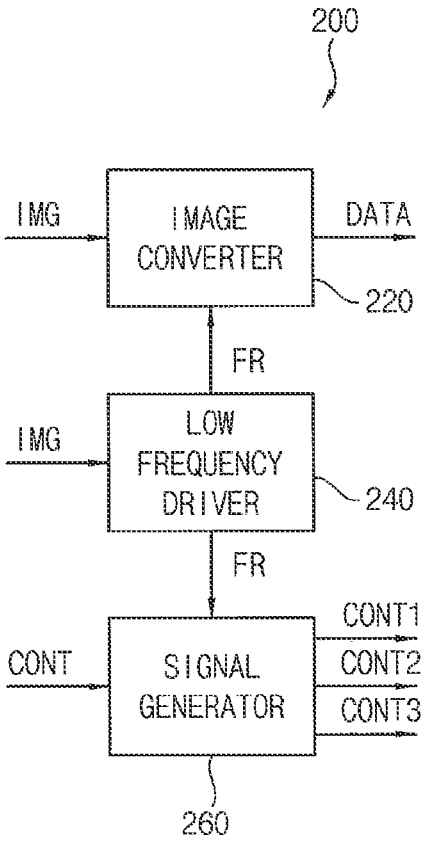
FIG. 2 is a block diagram illustrating a driving controller of FIG. 1.
Figure 3:
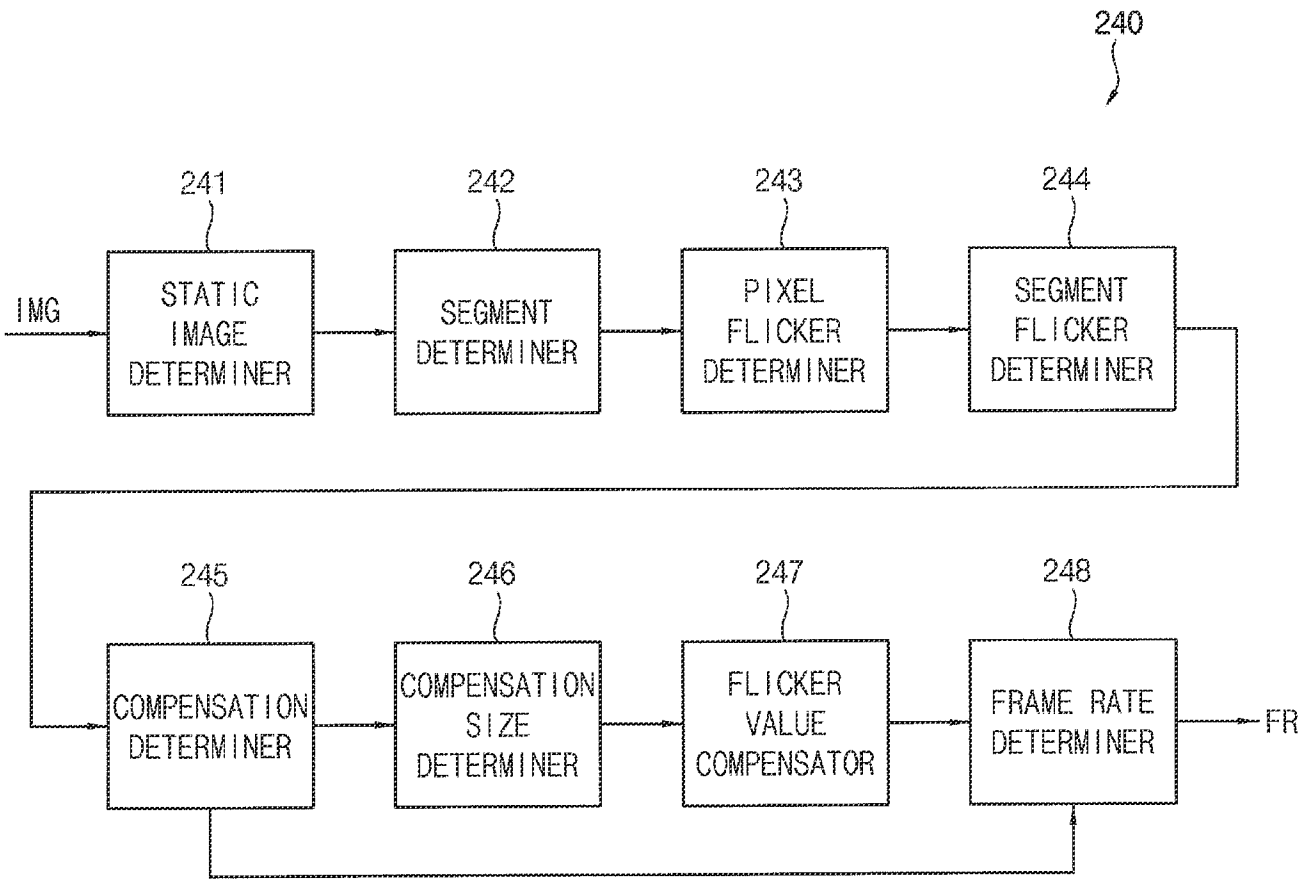
FIG. 3 is a block diagram illustrating a low frequency driver of FIG. 2.

FIG. 2 is a block diagram illustrating the driving controller 200 of FIG. 1. FIG. 3 is a block diagram illustrating a low frequency driver 240 of FIG. 2. FIG. 4 is a diagram illustrating segments defined by the segment determiner 242 of FIG. 3.

Referring to FIGS. 1 to 4, the driving controller 200 includes an image converter 220, a low frequency driver 240 and a signal generator 260.

The image converter 220 compensates grayscale data of the input image data IMG and rearranges the input image data IMG to generate the data signal DATA. The data signal DATA may correspond to a data type of the data driver 500 and may have a digital type. The image converter 220 outputs the data signal DATA to the data driver 500.

For example, the image converter 220 may include an adaptive color correcting part (not shown) and a dynamic capacitance compensating part (not shown). The adaptive color correcting part receives the grayscale data of the input image data IMG, and operates an adaptive color correction ("ACC"). The adaptive color correcting part may compensate the grayscale data using a gamma curve. The dynamic capacitance compensating part applies a dynamic capacitance compensation ("DCC"), which compensates the grayscale data of present frame data using previous frame data and the present frame data.

The low frequency driver 240 receives the input image data IMG. The low frequency driver 240 determines a frame rate FR of the display panel 100 based on the input image data IMG. The low frequency driver 240 may output the frame rate FR to the signal generator 260. The low frequency driver 240 may output the frame rate FR to the image converter 220.

The signal generator 260 receives the input control signal CONT. The signal generator 260 generates the first control signal CONT1 to control a driving timing of the gate driver 300 based on the input control signal CONT and the frame rate FR. The signal generator 260 generates the second control signal CONT2 to control a driving timing of the data driver 500 based on the input control signal CONT and the frame rate FR. The signal generator 260 generates the third control signal CONT3 to control a driving timing of the gamma reference voltage generator 400 based on the input control signal CONT and the frame rate FR.

The signal generator 260 outputs the first control signal CONT1 to the gate driver 300. The signal generator 260 outputs the second control signal CONT2 to the data driver 500. The signal generator 260 outputs the third control signal CONT3 to the gamma reference voltage generator 400.

The low frequency driver 240 includes a static image determiner 241, a segment determiner 242, a pixel flicker determiner 243, a segment flicker determiner 244, a compensation determiner 245, a compensation size determiner 246, a flicker value compensator 247 and a frame rate determiner 248, each of which may be hardware components such as, for example, integrated circuits, microprocessors, and the like.

The static image determiner 241 receives the input image data IMG. The static image determiner 241 determines whether the input image data IMG represent a static image or a video image. A video image may also be called a dynamic image, and may refer to an image portraying movement and/or motion.

The segment determiner 242 divides the input image data IMG into a plurality of segments S1 to S100. Although, the input image data IMG are divided into hundred segments in ten rows and ten columns in FIG. 4, the present inventive concept is not limited to the number of the segments.

Each of the segments S1 to S100 may have a rectangular shape. To human vision, the flicker in a rectangular shape including a longer side extending in a horizontal direction is perceived much than the flicker in a rectangular shape including a longer side extending in a vertical direction. Thus, each of the segments S1 to S100 may have the rectangular shape including a longer side extending in a horizontal direction to effectively prevent the flicker in the rectangular shape including the longer side extending in the horizontal direction. Alternatively, in other example embodiments, each of the segments S1 to S100 may have a square shape.

The pixel flicker determiner 243 determines a flicker value according to a luminance of a pixel. The flicker value represents a degree of flicker perceived by the user. The flicker value of the pixel may vary according to a luminance of the pixel and the frame rate FR of the display panel 100. For example, the flicker value may be generated by visual inspection by changing the luminance of the pixel and/or the frame rate FR of a test display panel. Generally, the flicker value may be relatively high in a low luminance area. In addition, the flicker value may be relatively high when the frame rate FR is low. Furthermore, the flicker value may be varied according to characteristics of the display panel 100.

The pixel flicker determiner 243 may determine the flicker value of the pixel using flicker values according to luminances of the pixels and the frame rates FR.

For example, the pixel flicker determiner 243 may include a lookup table including flicker values according to luminances of the pixels and the frame rates FR.

The input image data IMG may include a red grayscale R, a green grayscale G and a blue grayscale B. The input image data IMG may be determined in an RGB color space. The low frequency driver 240 may extract a luminance of the pixel from the input image data IMG in the RGB color space. For example, the low frequency driver 240 may include an RGB to Y converter to extract the luminance of the pixel from the input image data IMG in the RGB color space.

The segment flicker determiner 244 generates a flicker value of the segment. The segment flicker determiner 244 generates the flicker value of the segment using the flicker value of the pixel.

For example, the segment flicker determiner 244 may sum the flicker value of the pixels in the segment.

When the segment includes a hundred pixels, the pixel flicker determiner 243 may respectively determine a hundred flicker values of the hundred pixels, and the segment flicker determiner 244 may sum the hundred flicker values of the hundred pixels to generate the flicker value of the segment.

Alternatively, the segment flicker determiner 244 may set weights of the pixels according to positions of the pixels. The segment flicker determiner 244 may operate a weighted sum of the flicker values of the pixels to generate the flicker value of the segment.

For example, an outside portion of the display panel 100 is generally weak for the flicker so that the pixels in the outside portion may have a relatively high weight.

Alternatively, the segment flicker determiner 244 may operate various operations for the flicker value of the pixels to generate the flicker value of the segment.

For example, when the display panel 100 has a hundred segments, the segment flicker determiner 244 generates a hundred flicker values of first to hundredth segments S1 to S100.

In an example embodiment, the segment determiner 242, the pixel flicker determiner 243 and the segment flicker determiner 244 may operate when the input image data IMG represents a static image.

In an example embodiment, positions of the segment determiner 242 and the pixel flicker determiner 243 may be switched with each other.

The compensation determiner 245 may determine whether the flicker value of the segment is compensated or not according to the segment size.

For example, when the segment size is equal to or greater than a minimum size TH below which the flicker is perceivable to the user, the flicker value is not compensated. The minimum size TH in which the flicker is perceived by the user may be called a compensation threshold TH.

In contrast, when the segment size is less than the minimum size TH below which the flicker is perceivable to the user, the flicker value of the segment may be compensated based on the flicker value of the segment and the flicker value of the adjacent segment.

When the segment size is less than the compensation threshold TH, the compensation size determiner 246 may determine a mask size (a filter size) to compensate the flicker value. The mask size (the filter size) may mean a number of a compensation target segment and segments adjacent to the compensation target segment and used for the compensation. The mask size (the filter size) may mean a number of a flicker value of the compensation target segment and flicker values of the segments adjacent to the compensation target segment and used for the compensation. The mask size (the filter size) may be called a compensation size.

The flicker value compensator 247 may compensate the flicker value of the segment based on the flicker value of the segment and the flicker values of the adjacent segments. The flicker value compensator 247 may compensate the flicker value of the segment based on the flicker value of the segment and the flicker values of the adjacent segments corresponding to the compensation size.

The frame rate determiner 248 determines the frame rate FR of the display panel 100 based on the flicker value of the segment.

The frame rate determiner 248 may compare the maximum flicker value of the segments to a threshold to determine the frame rate FR.

The frame rate determiner 248 may compare an average of flicker values of segments having relatively high flicker values to a threshold to determine the frame rate FR of the display panel 100. For example, the relatively high flicker values may be greater than a predetermined flicker value.

Alternatively, the frame rate determiner 248 may perform various operations for the flicker value of the segments to determine the frame rate FR.

In an example embodiment, when the input image data IMG represents a video image, the frame rate determiner 248 may determine the frame rate FR as a high frequency regardless of the flicker value of the segment. When the input image data IMG represents a static image, the frame rate determiner 248 may determine the frame rate FR as one of low frequencies based on the flicker value of the segment.

Figures 5A, 5B:
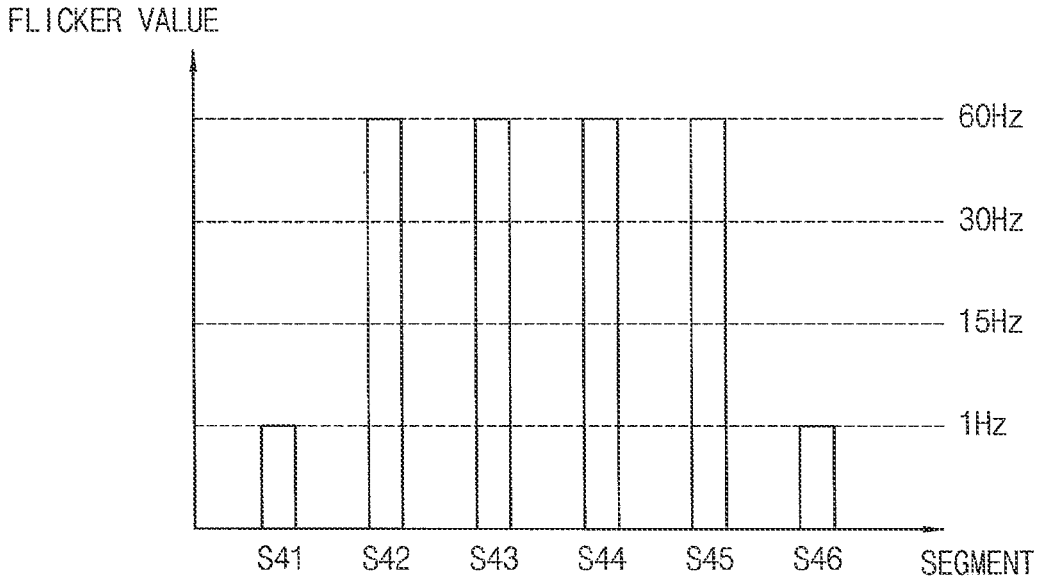
FIGS. 5A and 5B illustrate flicker values of the segments according to a first image.
Figures 6A, 6B:
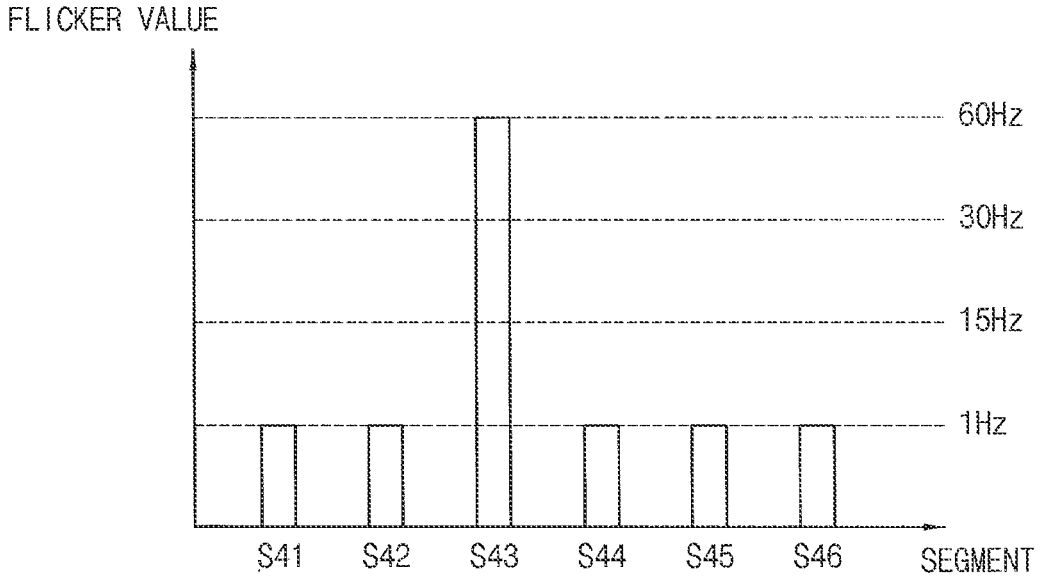
FIGS. 6A and 6B illustrate flicker values of the segments according to a second image.
Figures 7A, 7B:
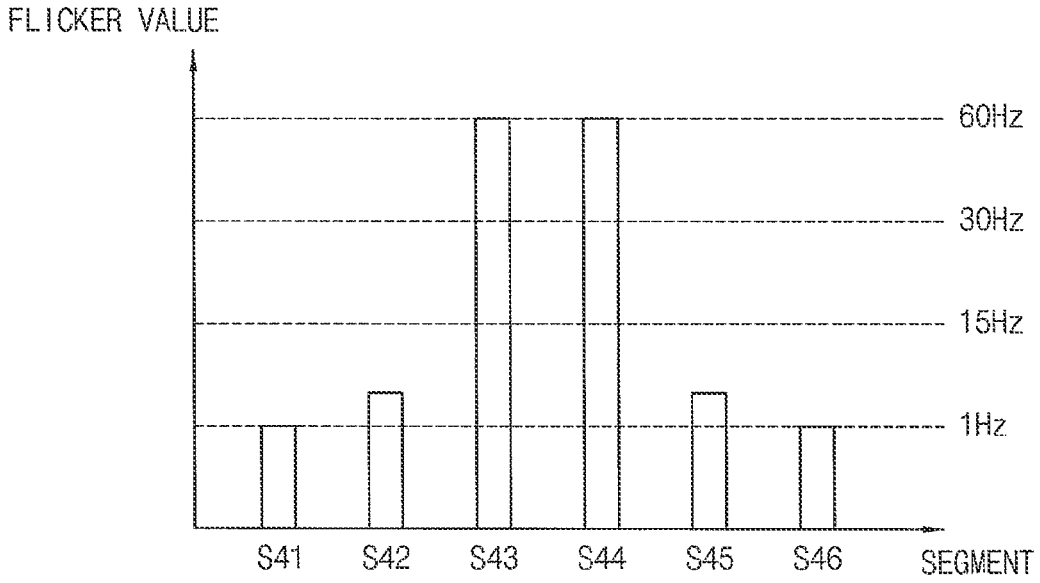
FIGS. 7A and 7B illustrate a method of compensating the flicker values of the segments according to the first image.
Figures 8A, 8B:
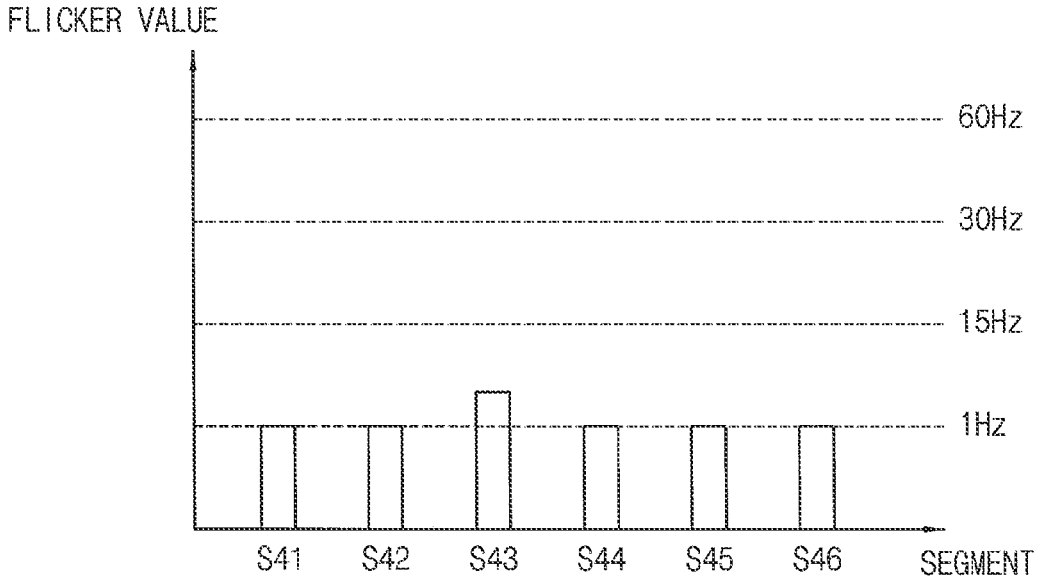
FIGS. 8A and 8B illustrate a method of compensating the flicker values of the segments according to the second image.

FIGS. 5A and 5B illustrate flicker values of the segments according to a first image. FIGS. 6A and 6B illustrate flicker values of the segments according to a second image. FIGS. 7A and 7B illustrate a method of compensating the flicker values of the segments according to the first image. FIGS. 8A and 8B illustrate a method of compensating the flicker values of the segments according to the second image.

The method of determining the flicker value of the segment and the frame rate FR corresponding to the flicker value is explained hereinafter referring to FIGS. 5A to 8B.

In FIG. 5A, the input image of the display panel 100 is the first image. In the first image, segments S32 to S35, S42 to S45 and S52 to S55 in three rows and four columns have a flicker value corresponding to 60 Hz and segments other than the segments S32 to S35, S42 to S45 and S52 to S55 in three rows and four columns have a flicker value corresponding to 1 Hz.

The flicker values of the segments may be represented as shown in FIG. 5B. The frame rate determiner 248 may determine the frame rate FR of the display panel 100 to 60 Hz based on the maximum value S42, S43, S44 and S45 of the flicker values of the segments. "Maximum value," as used herein, refers to maximum flicker value of a segment.

In FIG. 6A, the input image of the display panel 100 is the second image. In the second image, a segment S43 has a flicker value corresponding to 60 Hz and segments other than the segment S43 have a flicker value corresponding to 1 Hz.

The flicker values of the segments may be represented as FIG. 6B. The frame rate determiner 248 may determine the frame rate FR of the display panel 100 to 60 Hz based on the maximum value S43 of the flicker values of the segments.

For example, when the segment size is quite small and the segments S32 to S35, S42 to S45, and S52 to S55 in three rows and four columns have the high flicker values as shown in FIG. 5A, a high frame rate driving may be required to prevent the user from perceiving the flicker. In contrast, when the segment size is quite small and the single segment S43 has the high flicker value as shown in FIG. 6A, the flicker of the single segment S43 may not be perceived by the user. In the latter case, high frame rate driving may not be required. Avoiding the perception of flicker by using the high flicker values of neighboring segments (e.g., by adjusting the frame rate driving speed) is herein referred to as "compensating."

When the flicker values of the segments are not compensated based on the flicker values of the adjacent segments, the display panel in FIG. 5A and the display panel in FIG. 6A are driven in a high frame rate of 60 Hz. In contrast, when the flicker values of the segments are compensated based on the flicker values of the adjacent segments, the display panel in FIG. 5A is driven in a high frame rate of 60 Hz and the display panel in FIG. 6A may be driven in a frame rate less than 60 Hz.

In FIG. 7A, the input image of the display panel 100 is the first image, similar to that of FIG. 5A. In FIG. 7B, the flicker value of the segment may be compensated using the flicker values of the adjacent segments.

When the compensation size is 3*3, a flicker value of a forty-second segment S42 may be compensated using flicker values of segments S31, S32, S33, S41, S42, S43, S51, S52 and S53. For example, the flicker value of the forty-second segment S42 may be compensated using an average of the flicker values of the segments S31, S32, S33, S41, S42, S43, S51, S52 and S53. For example, the flicker value of the forty-second segment S42 may be compensated using a weighted average of the flicker values of the segments S31, S32, S33, S41, S42, S43, S51, S52 and S53. For example, the flicker value of the forty-second segment S42 may have a highest weight and the weight may decrease as the distance from the forty-second segment S42 increases.

When the compensation size is 3*3, a flicker value of a forty-third segment S43 may be compensated using flicker values of segments S32, S33, S34, S42, S43, S44, S52, S53 and S54. When the compensation size is 3*3, a flicker value of a forty-fourth segment S44 may be compensated using flicker values of segments S33, S34, S35, S43, S44, S45, S53, S54 and S55.

When the compensation size is 5*5, the flicker value of the forty-third segment S43 may be compensated using flicker values of segments S21, S22, S23, S24, S25, S31, S32, S33, S34, S35, S41, S42, S43, S44, S45, S51, S52, S53, S54, S55, S61, S62, S63, S64 and S65. When the compensation size is 5*5, the flicker value of the forty-fourth segment S44 may be compensated using flicker values of segments S22, S23, S24, S25, S26, S32, S33, S34, S35, S36, S42, S43, S44, S45, S46, S52, S53, S54, S55, S56, S62, S63, S64, S65 and S66.

The flicker value of the segment compensated by the flicker value compensator 247 may be represented as FIG. 7B. The frame rate determiner 248 may determine the frame rate FR of the display panel 100 to 60 Hz based on the maximum value S43 and S44 of the flicker values of the segments.

In FIG. 8A, the input image of the display panel 100 is the second image similar to that of FIG. 6A. In FIG. 8B, the flicker value of the segment may be compensated using the flicker values of the adjacent segments.

The flicker value of the segment compensated by the flicker value compensator 247 may be represented as FIG. 8B. The frame rate determiner 248 may determine the frame rate FR of the display panel 100 to 15 Hz based on the maximum value S43 of the flicker values of the segments.

In FIG. 8B, when the flicker value of the forty-third segment S43 is the maximum value, the frame rate determiner 248 may compare the flicker value of the forty-third segment S43 to thresholds of frame rates. The flicker value of the forty-third segment S43 is greater than a threshold of 1 Hz and equal to or less than a threshold of 15 Hz so that the frame rate FR of the display panel 100 may be determined as 15 Hz.

In FIG. 6B, when the segment size is quite small, the flicker may not be shown to a user. However, the frame rate FR is determined using only the flicker value of the segment in FIG. 6B, the display panel 100 may be driven in a higher frame rate than necessary. In contrast, in FIG. 8B, the flicker value of the segment is compensated using the flicker values of adjacent segments so that the frame rate of the display panel 100 may be reduced without unnecessary deterioration of the display quality of the display panel 100.

When the flicker value of the segment is compensated using the flicker values of adjacent segments without considering the segment size, the display panel 100 may be driven in an improper frame rate FR.

Figure 9A:
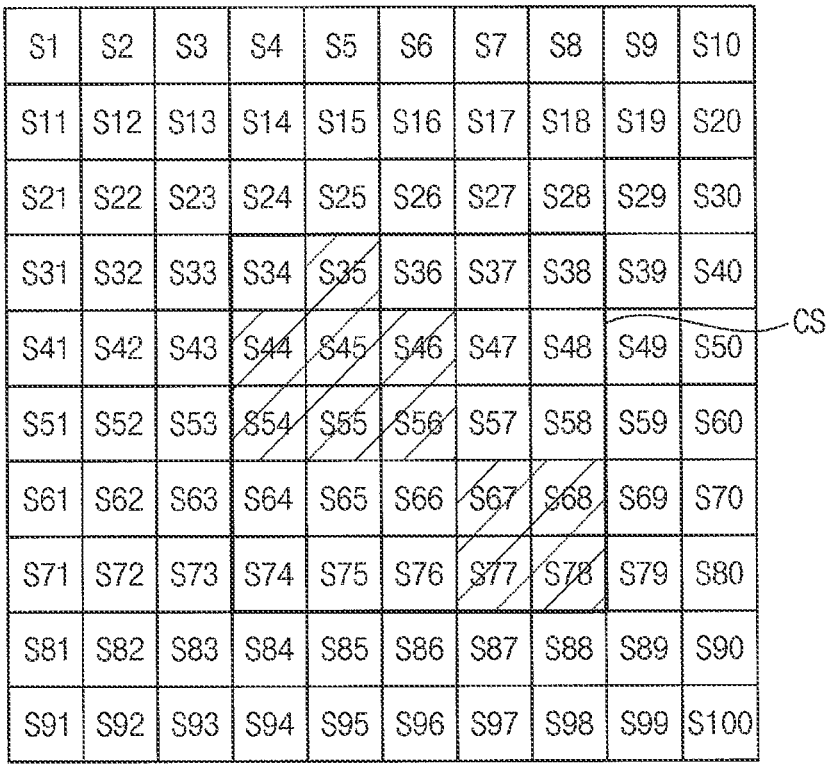

FIGS. 9A to 9C illustrate a method of compensating the flicker values of the segments without considering a segment size.

In FIG. 9A, segments S35, S44, S45, S46, S54, S55, S56, S67, S68, S77 and S78 may represent a grayscale value of 19 and segments S34, S36, S37, S38, S47, S48, S57, S58, S64, S65, S66, S74, S75 and S76 may represent a grayscale value of 255.

The flicker value of the grayscale value of 19 may be 204 as shown in FIG. 9B and the frame rate FR corresponding to the grayscale value of 19 may be 30 Hz as shown in FIGS. 9B and 9C. The flicker value of the grayscale value of 255 may be 0 as shown in FIG. 9B and the frame rate FR corresponding to the grayscale value of 255 may be 1 Hz as shown in FIGS. 9B and 9C.

In FIGS. 9A to 9C, the segment size is large enough so that the flicker of the single segment may be perceived by the user. In this case, when the display panel 100 is driven in the frame rate FR of 30 Hz corresponding to the grayscale value of 19, the flicker may not be perceived by the user.

When the flicker value of the segment is compensated using the compensation size CS of 5*5 by the flicker value compensator 247 without considering the segment size, the flicker value corresponding to the compensation size CS of 5*5 may be an average value of the segments S34, S35, S36, S37, S38, S44, S45, S46, S47, S48, S54, S55, S56, S57, S58, S64, S65, S66, S67, S68, S74, S75, S76, S77 and S78. The average value is 89.8. According to FIG. 9C, the frame rate FR corresponding to the flicker value of 89.8 may be 2 Hz. When the display panel 100 is driven in the frame rate FR of 2 Hz, the flicker of the display panel 100 may be perceived by the user.

Figure 10:
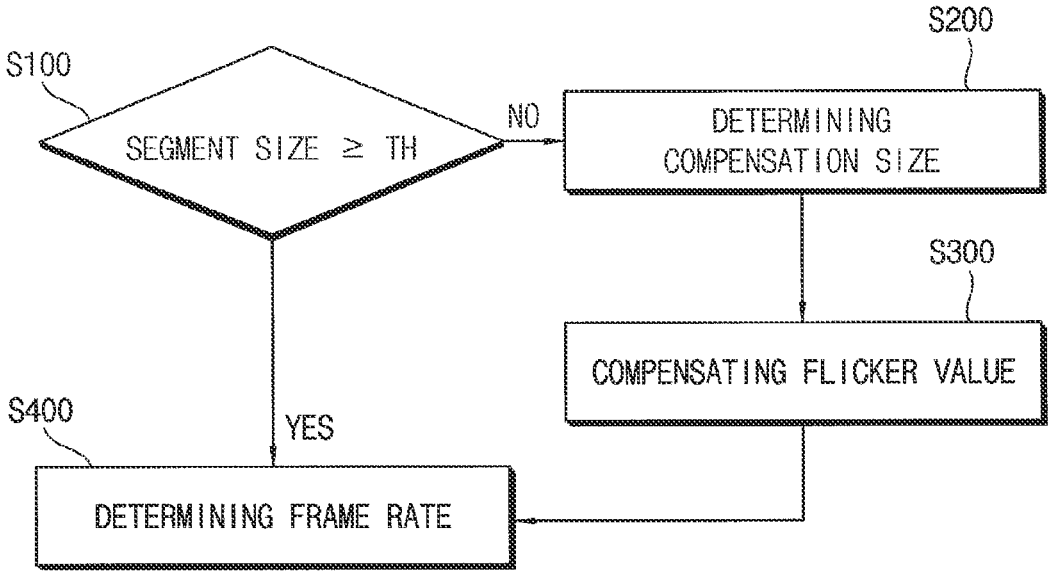
FIG. 10 is a flowchart diagram illustrating operations of a compensation determiner, a compensation size determiner, a flicker value compensator and a frame rate determiner of FIG. 3.

FIG. 10 is a flowchart diagram illustrating operations of a compensation determiner 245, a compensation size determiner 246, a flicker value compensator 247 and a frame rate determiner 248 of FIG. 3.

Referring to FIGS. 1 to 10, the low frequency driver 240 of the present example embodiment may include the compensation determiner 245 to determine whether to compensate the flicker value of the segment according to the segment size or not (step S100).

When the segment size is equal to or greater than the compensation threshold TH, the compensation determiner 245 may determine not to compensate the flicker value of the segment. When the segment size is less than the compensation threshold TH, the compensation determiner 245 may determine to compensate the flicker value of the segment.

When the segment size is large enough such that the flicker of the single segment is perceived by the user, the steps S200 and S300 of compensating the flicker value of the segment may be skipped. Accordingly, the frame rate FR may be determined using the uncompensated flicker value of the segment (step S400).

In contrast, when the segment size is small such that the flicker of the single segment is not perceived by the user, the flicker value of the segment may be compensated through the steps S200 and S300. Accordingly, the frame rate FR may be determined using the compensated flicker value of the segment (step S400).

When the segment size is less than the compensation threshold TH, the compensation size determiner 246 may determine the compensation size CS representing the number of the flicker value of the segment and the flicker values of the adjacent segments used to compensate the flicker value of the segment (step S200).

The compensation size CS may be determined such that a multiplication of the segment size and the compensation size CS is equal to or greater than the compensation threshold TH. For example, the compensation size CS may be determined as a minimum integer satisfying that the multiplication of the segment size and the compensation size CS is equal to or greater than the compensation threshold TH.

For example, when the compensation threshold TH—meaning the segment size in which the flicker is perceived by the user—is 300*300 and the actual segment size is 512*512, the steps S200 and S300 of compensating the flicker value of the segment may be skipped and the frame rate FR may be determined using the flicker value of the uncompensated segment.

For example, when the compensation threshold TH, meaning the segment size in which the flicker is perceived by the user, is 300*300 and the actual segment size is 64*64, the flicker value of the segment may be compensated through the steps S200 and S300 and the frame rate FR may be determined using the flicker value of the segment which is compensated.

Herein, the compensation size CS may be determined as a value greater than 4.6875*4.6875. The compensation size CS may be determined from among the values 5*5, 6*6, 7*7, 8*8 and so on. For example, the compensation size CS may be determined as the value of 5*5.

The compensation size determiner 246 may independently determine a first compensation size and a second compensation size. The first compensation size means the number of the flicker value of the segment and the flicker values of the adjacent segments used to compensate the flicker value of the segment in the first direction D1 (a row direction). The second compensation size means the number of the flicker value of the segment and the flicker values of the adjacent segments used to compensate the flicker value of the segment in the second direction D2 (a column direction).

As explained above, the first compensation size and the second compensation size may be equal to each other having such values as 5*5, 6*6, 7*7, 8*8 and so on. Alternatively, the first compensation size and the second compensation size may be different from each other when a flicker degree in the first direction D1 is different from a flicker degree in the second direction D2 according to the characteristics of the display panel 100.

The flicker value compensator 247 may compensate the flicker value of the segment based on the compensation size CS (step S300).

The frame rate determiner 248 may determine the frame rate FR based on the compensated flicker value or the uncompensated flicker value (step S400).

According to the present example embodiment, the frame rate FR is determined according to the image displayed on the display panel 100 so that the power consumption of the display apparatus may be reduced. In addition, the frame rate FR is determined using the flicker value of the segment of the image displayed on the display panel 100 so that the flicker of the image may be prevented (e.g., the flicker perceived by a user) and the display quality of the display panel 100 may be enhanced. In addition, the flicker values of the segments are compensated using the flicker values of the adjacent segments so that the display quality of the display panel 100 may be further enhanced.

Figure 11:
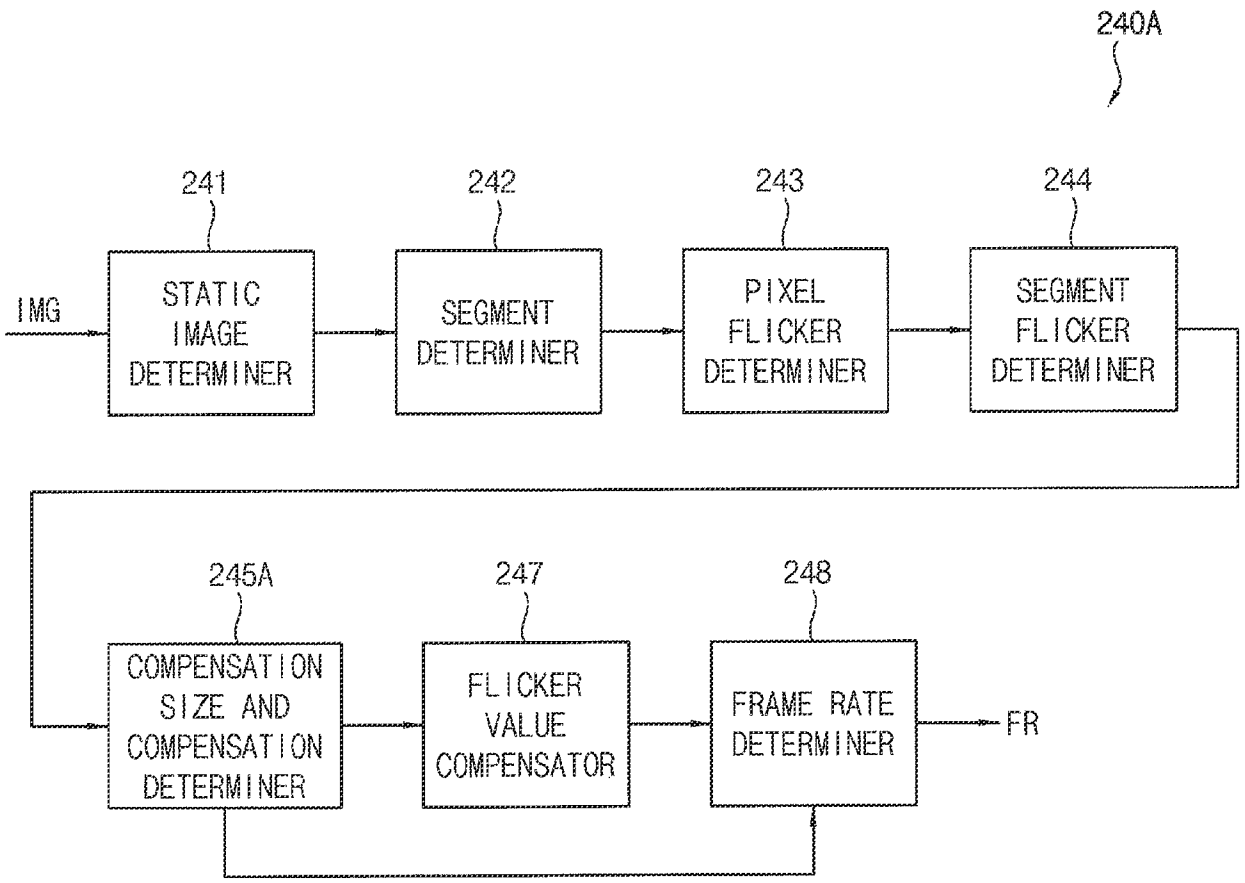
FIG. 11 is a block diagram illustrating a low frequency driver of a display apparatus according to an example embodiment of the present inventive concept.
Figure 12:
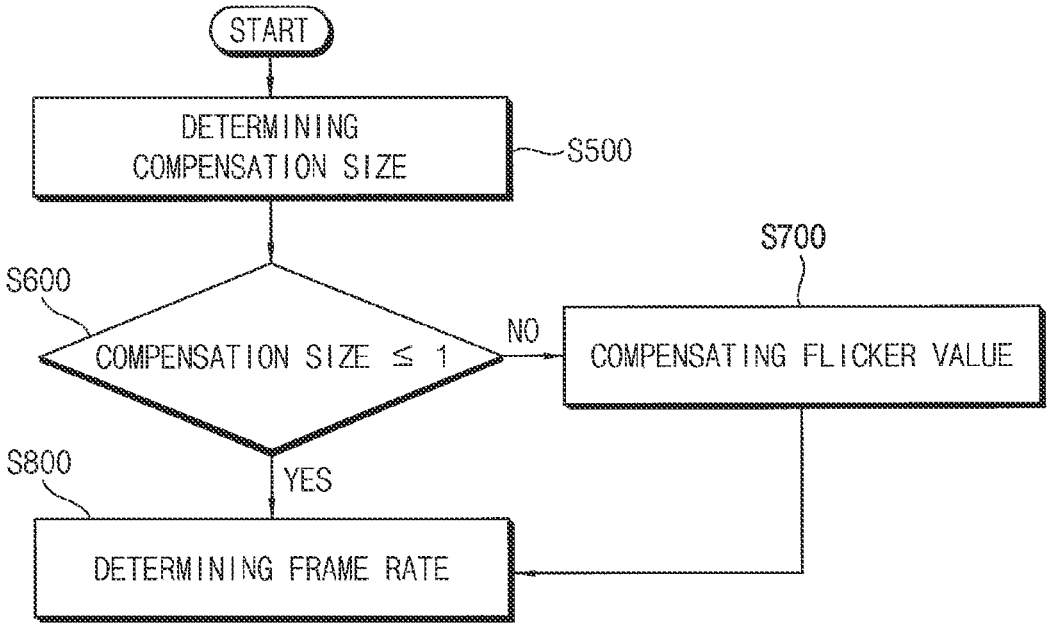
FIG. 12 is a flowchart diagram illustrating operations of a compensation size and compensation determiner, a flicker value compensator and a frame rate determiner of FIG. 11.

FIG. 11 is a block diagram illustrating a low frequency driver of a display apparatus according to an example embodiment of the present inventive concept. FIG. 12 is a flowchart diagram illustrating operations of a compensation size and compensation determiner, a flicker value compensator and a frame rate determiner of FIG. 11.

The method of driving the display panel and the display apparatus according to the present example embodiment is substantially the same as the method of driving the display panel and the display apparatus of the previous example embodiment explained referring to FIGS. 1 to 10 except for the structure and the operation of the low frequency driver. Thus, the same reference numerals will be used to refer to the same or like parts as those described in the previous example embodiment of FIGS. 1 to 10 and any repetitive explanation concerning the above elements will be omitted.

Referring to FIGS. 1, 2, 4 to 9C, 11 and 12, the display apparatus includes a display panel 100 and a display panel driver. The display panel driver includes a driving controller 200, a gate driver 300, a gamma reference voltage generator 400 and a data driver 500.

The driving controller 200 includes an image converter 220, a low frequency driver 240A and a signal generator 260.

The low frequency driver 240A receives the input image data IMG. The low frequency driver 240A determines a frame rate FR of the display panel 100 based on the input image data IMG. The low frequency driver 240A may output the frame rate FR to the signal generator 260. The low frequency driver 240A may output the frame rate FR to the image converter 220.

The low frequency driver 240A includes a static image determiner 241, a segment determiner 242, a pixel flicker determiner 243, a segment flicker determiner 244, a compensation size and compensation determiner 245A, a flicker value compensator 247 and a frame rate determiner 248.

In the present example embodiment, the compensation size CS may be determined prior to determining whether the compensation is operated or not based on the segment size.

The compensation size and compensation determiner 245A determines the compensation size CS by dividing the compensation threshold TH by the segment size (step S500). The compensation size and compensation determiner 245A determines whether or not to compensate the flicker value of the segment based on the determined compensation size CS (step S600).

When the determined compensation size CS is equal to or less than 1, the compensation of the flicker value of the segment may not be required. Thus, when the determined compensation size CS is equal to or less than 1, a step S700 of compensating the flicker value of the segment may be skipped and the frame rate FR may be determined based on the compensated flicker value of the segment (step S800).

When the determined compensation size CS is greater than 1, compensation of the flicker value of the segment may be required. Thus, when the determined compensation size CS is greater than 1, the flicker value of the segment may be compensated (step S700) and the frame rate FR may be determined based on the flicker value of the segment which is compensated (step S800).

For example, when the compensation threshold TH—meaning the segment size in which the flicker is perceived to the user—is 300*300 and the actual segment size is 512*512, the compensation size CS may be (300*300)/(512*512) so that the compensation size CS may be less than 1. Thus, the step S700 of compensating the flicker value of the segment may be skipped and the frame rate FR may be determined based on the compensated flicker value of the segment.

For example, when the compensation threshold TH—meaning the segment size in which the flicker is perceived to the user—is 300*300 and the actual segment size is 64*64, the compensation size CS may be (300*300)/(64*64) so that the compensation size CS may be greater than 1. Thus, the flicker value of the segment may be compensated (step S700) and the frame rate FR may be determined based on the compensated flicker value of the segment.

The compensation size and compensation determiner 245A may independently determine a first compensation size and a second compensation size. The first compensation size may mean the number of the flicker value of the segment and the flicker values of the adjacent segments used to compensate the flicker value of the segment in the first direction D1 (a row direction). The second compensation size may mean the number of the flicker value of the segment and the flicker values of the adjacent segments used to compensate the flicker value of the segment in the second direction D2 (a column direction).

The flicker value compensator 247 may compensate the flicker value of the segment based on the compensation size CS (step S700).

The frame rate determiner 248 may determine the frame rate FR based on the compensated flicker value or the uncompensated flicker value (step S800).

According to the present example embodiment, the frame rate FR is determined according to the image displayed on the display panel 100 so that the power consumption of the display apparatus may be reduced. In addition, the frame rate FR is determined using the flicker value of the segment of the image displayed on the display panel 100 so that the flicker of the image may be prevented and the display quality of the display panel 100 may be enhanced. In addition, the flicker values of the segments are compensated using the flicker values of the adjacent segments so that the display quality of the display panel 100 may be further enhanced.

Figure 13:
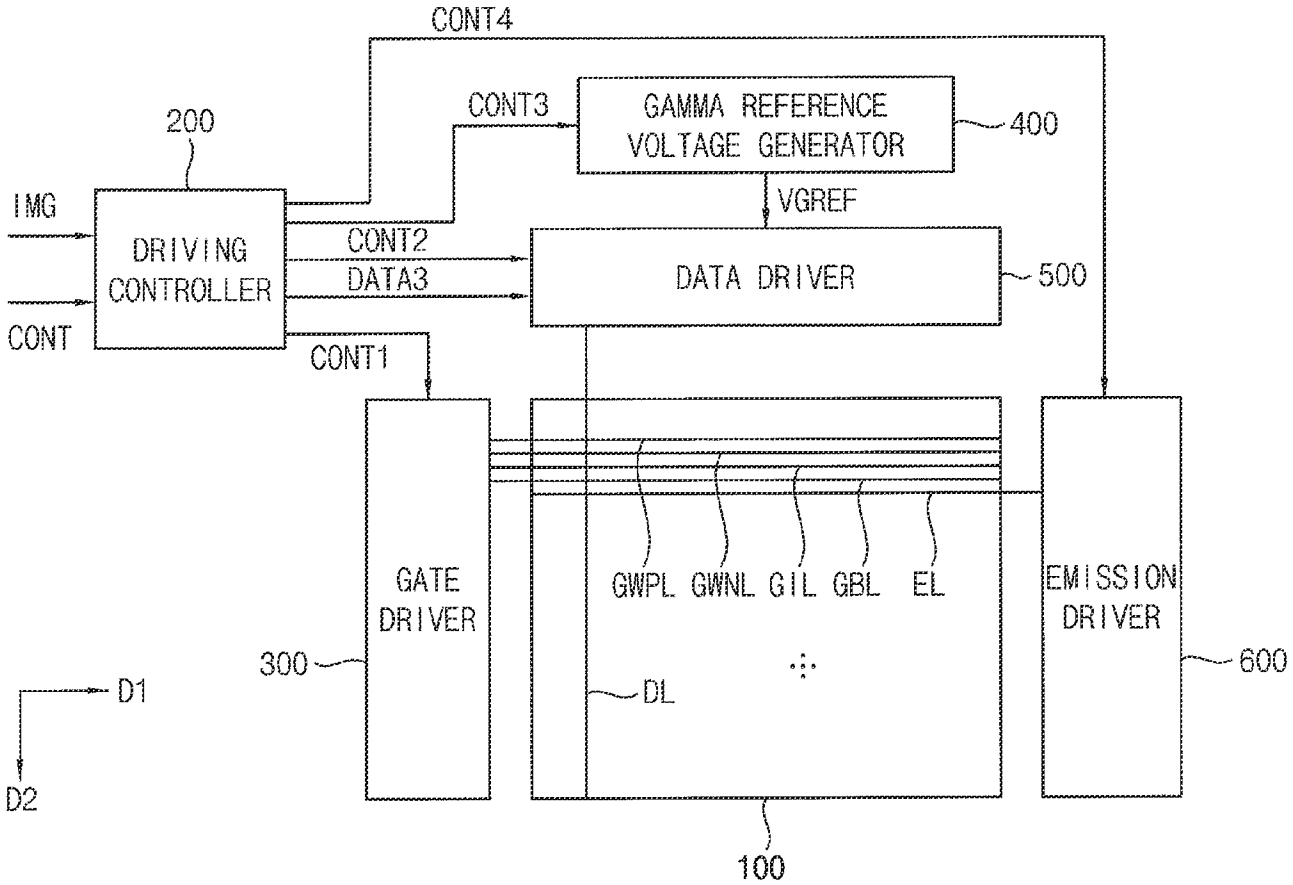
FIG. 13 is a block diagram illustrating a display apparatus according to an example embodiment of the present inventive concept.
Figure 14:
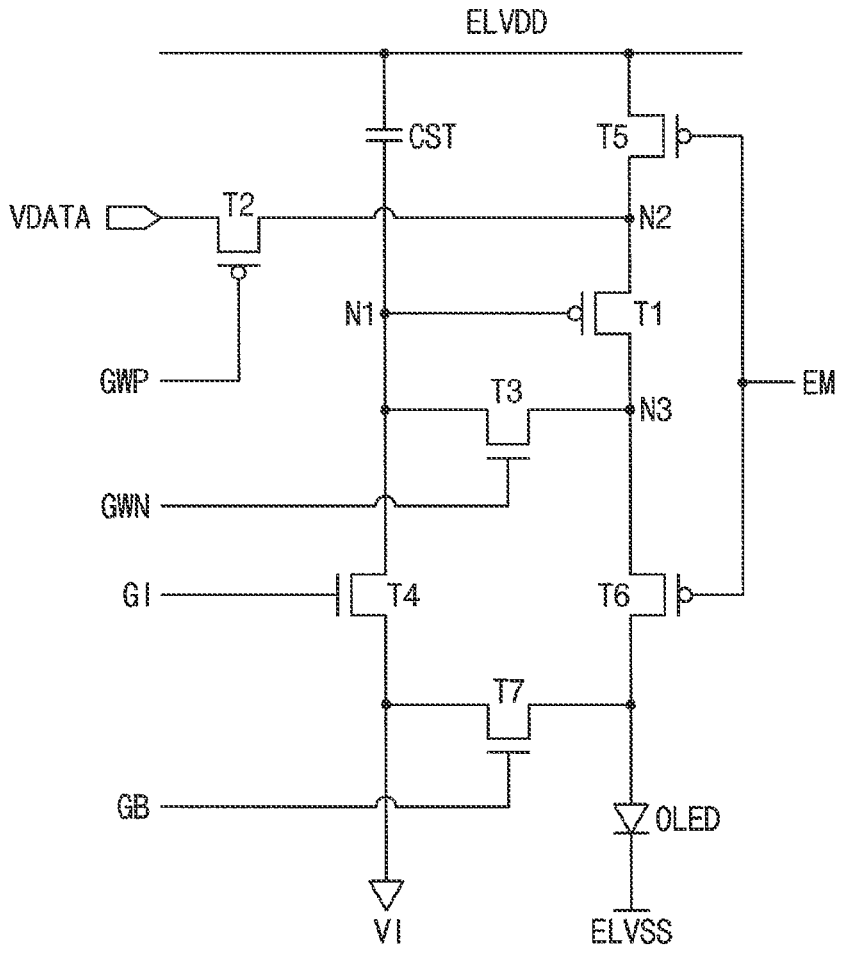
FIG. 14 is a circuit diagram illustrating a pixel of a display panel of FIG. 13.
Figure 15:
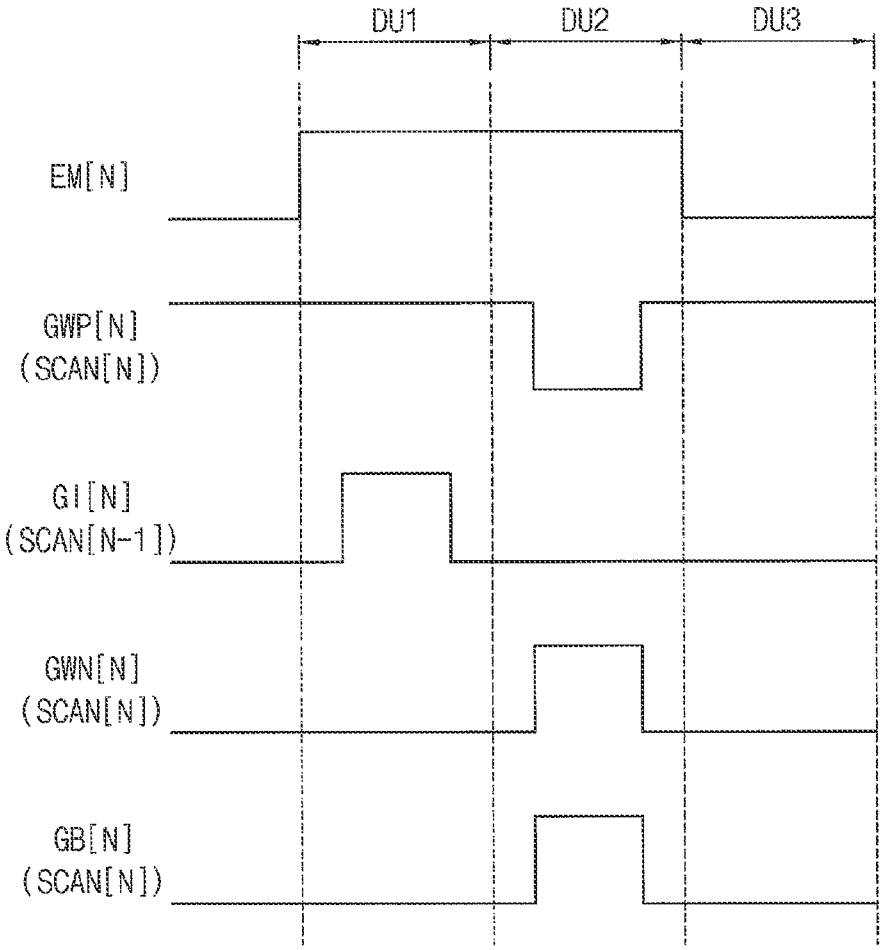
FIG. 15 is a timing diagram illustrating input signals applied to the pixel of FIG. 14.

FIG. 13 is a block diagram illustrating a display apparatus according to an example embodiment of the present inventive concept. FIG. 14 is a circuit diagram illustrating a pixel of a display panel of FIG. 13. FIG. 15 is a timing diagram illustrating input signals applied to the pixel of FIG. 14.

The method of driving the display panel and the display apparatus according to the present example embodiment is substantially the same as the method of driving the display panel and the display apparatus of the previous example embodiment explained referring to FIGS. 1 to 10 except for some of the structure of the display panel. Thus, the same reference numerals will be used to refer to the same or like parts as those described in the previous example embodiment of FIGS. 1 to 10 and any repetitive explanation concerning the above elements will be omitted.

Referring to FIGS. 2 to 10 and 13 to 15, the display apparatus includes a display panel 100 and a display panel driver. The display panel driver includes a driving controller 200, a gate driver 300, a gamma reference voltage generator 400, a data driver 500 and an emission driver 600.

The display panel 100 has a display region on which an image is displayed and a peripheral region adjacent to the display region.

The display panel 100 includes a plurality of gate lines GWPL, GWNL, GIL and GBL, a plurality of data lines DL, a plurality of emission lines EL, and a plurality of pixels electrically connected to the gate lines GWPL, GWNL, GIL and GBL, the data lines DL and the emission lines EL. The gate lines GWPL, GWNL, GIL and GBL may extend in a first direction D1, the data lines DL may extend in a second direction D2 crossing the first direction D1 and the emission lines EL may extend in the first direction D1.

The driving controller 200 receives input image data IMG and an input control signal CONT from an external apparatus (not shown).

The driving controller 200 generates a first control signal CONT1, a second control signal CONT2, a third control signal CONT3, a fourth control signal CONT4 based on the input control signal CONT. The driving controller 200 also generates a data signal DATA based on the input image data IMG.

The emission driver 600 generates emission signals to drive the emission lines EL in response to the fourth control signal CONT4 received from the driving controller 200. The emission driver 600 may output the emission signals to the emission lines EL.

The display panel 100 includes the plurality of the pixels. Each pixel includes an organic light emitting element OLED.

The pixel receives a data write gate signal GWP and GWN, a data initialization gate signal GI, an organic light emitting element initialization signal GB, the data voltage VDATA and the emission signal EM and the organic light emitting element OLED of the pixel emits light corresponding to the level of the data voltage VDATA to display the image.

In the present example embodiment, the pixel may include a switching element of a first type and a switching element of a second type different from the first type. The switching element of the first type may be a polysilicon thin film transistor. The switching element of the first type may be a low temperature polysilicon (LTPS) thin film transistor. The switching element of the second type may be an oxide thin film transistor. The switching element of the first type may be a P-type transistor and the switching element of the second type may be an N-type transistor.

The data write gate signal may include a first data write gate signal GWP and a second data write gate signal GWN. The first data write gate signal GWP may be applied to the P-type transistor so that the first data write gate signal GWP has an activation signal of a low level corresponding to a data writing timing. The second data write gate signal GWN may be applied to the N-type transistor so that the second data write gate signal GWN has an activation signal of a high level corresponding to the data writing timing.

At least one of the pixels may include first to seventh pixel switching elements T1 to T7, a storage capacitor CST and the organic light emitting element OLED.

The first pixel switching element T1 includes a control electrode connected to a first node N1, an input electrode connected to a second node N2 and an output electrode connected to a third node N3.

The first pixel switching element T1 may be a polysilicon thin film transistor. The first pixel switching element T1 may be the P-type thin film transistor. The control electrode of the first pixel switching element T1 may be a gate electrode, the input electrode of the first pixel switching element T1 may be a source electrode and the output electrode of the first pixel switching element T1 may be a drain electrode.

The second pixel switching element T2 includes a control electrode to which the first data write gate signal GWP is applied, an input electrode to which the data voltage VDATA is applied and an output electrode connected to the second node N2.

The second pixel switching element T2 may be a poly silicon thin film transistor. The second pixel switching element T2 may be the P-type thin film transistor. The control electrode of the second pixel switching element T2 may be a gate electrode, the input electrode of the second pixel switching element T2 may be a source electrode and the output electrode of the second pixel switching element T2 may be a drain electrode.

The third pixel switching element T3 includes a control electrode to which the second data write gate signal GWN is applied, an input electrode connected to the first node N1 and an output electrode connected to the third node N3.

The third pixel switching element T3 may be the oxide thin film transistor. The third pixel switching element T3 may be the N-type thin film transistor. The control electrode of the third pixel switching element T3 may be a gate electrode, the input electrode of the third pixel switching element T3 may be a source electrode and the output electrode of the third pixel switching element T3 may be a drain electrode.

The fourth pixel switching element T4 includes a control electrode to which the data initialization gate signal GI is applied, an input electrode to which an initialization voltage VI is applied and an output electrode connected to the first node N1.

The fourth pixel switching element T4 may be the oxide thin film transistor. The fourth pixel switching element T4 may be the N-type thin film transistor. The control electrode of the fourth pixel switching element T4 may be a gate electrode, the input electrode of the fourth pixel switching element T4 may be a source electrode and the output electrode of the fourth pixel switching element T4 may be a drain electrode.

The fifth pixel switching element T5 includes a control electrode to which the emission signal EM is applied, an input electrode to which a high power voltage ELVDD is applied and an output electrode connected to the second node N2.

The fifth pixel switching element T5 may be a polysilicon thin film transistor. The fifth pixel switching element T5 may be the P-type thin film transistor. The control electrode of the fifth pixel switching element T5 may be a gate electrode, the input electrode of the fifth pixel switching element T5 may be a source electrode and the output electrode of the fifth pixel switching element T5 may be a drain electrode.

The sixth pixel switching element T6 includes a control electrode to which the emission signal EM is applied, an input electrode connected to the third node N3 and an output electrode connected to an anode electrode of the organic light emitting element OLED.

The sixth pixel switching element T6 may be a polysilicon thin film transistor. The sixth pixel switching element T6 may be a P-type thin film transistor. The control electrode of the sixth pixel switching element T6 may be a gate electrode, the input electrode of the sixth pixel switching element T6 may be a source electrode and the output electrode of the sixth pixel switching element T6 may be a drain electrode.

The seventh pixel switching element T7 includes a control electrode to which the organic light emitting element initialization gate signal GB is applied, an input electrode to which the initialization voltage VI is applied and an output electrode connected to the anode electrode of the organic light emitting element OLED.

The seventh pixel switching element T7 may be the oxide thin film transistor. The seventh pixel switching element T7 may be the N-type thin film transistor. The control electrode of the seventh pixel switching element T7 may be a gate electrode, the input electrode of the seventh pixel switching element T7 may be a source electrode and the output electrode of the seventh pixel switching element T7 may be a drain electrode.

The storage capacitor CST includes a first electrode to which the high power voltage ELVDD is applied and a second electrode connected to the first node N1.

The organic light emitting element OLED includes the anode electrode connected to the output electrode of the sixth switching element T6 and a cathode electrode to which a low power voltage ELVSS is applied.

As shown in FIG. 15, during a first duration DU1, the first node N1 and the storage capacitor CST are initialized in response to the data initialization gate signal GI. During a second duration DU2, a threshold voltage of the first pixel switching element T1 is compensated and the data voltage VDATA of which the threshold voltage is compensated is written to the first node N1 in response to the first and second data write gate signals GWP and GWN. In addition, during the second duration DU2, the anode electrode of the organic light emitting element OLED is initialized in response to the organic light emitting element initialization gate signal GB. During a third duration DU3, the organic light emitting element OLED emits the light in response to the emission signal EM so that the display panel 100 displays the image.

In the present example embodiment, some of the pixel switching elements may be designed using the oxide thin film transistors. In the present example embodiment, the third pixel switching element T3, the fourth pixel switching element T4 and the seventh pixel switching element T7 may be the oxide thin film transistors. The first pixel switching element T1, the second pixel switching element T2, the fifth pixel switching element T5 and the sixth pixel switching element T6 may be a polysilicon thin film transistors.

The display panel 100 may be driven in a normal driving mode in which the display panel 100 is driven in a normal driving frequency and in a low frequency driving mode in which the display panel 100 is driven in a low frequency. The low frequency may be lower than the normal driving frequency.

For example, when the input image data represent a video image, the display panel 100 may be driven in the normal driving mode. When the input image data represent a static image, the display panel may be driven in the low frequency driving mode. When the display apparatus is operated in the always on mode, the display panel may be driven in the low frequency driving mode.

The display panel 100 may be driven in a unit of frame. The display panel 100 may be refreshed in every frame in the normal driving mode. Thus, the normal driving mode includes only writing frames in which the data is written in the pixel.

In the low frequency driving mode, the display panel 100 may be refreshed in the low frequency. Thus, the low frequency driving mode includes the writing frames in which the data is written in the pixel and holding frames in which the written data is maintained without writing the data in the pixel.

For example, when the frequency of the normal driving mode is 60 Hz and the frequency of the low frequency driving mode is 1 Hz, the low frequency driving mode includes one writing frame and fifty-nine holding frames in a second. For example, when the frequency of the normal driving mode is 60 Hz and the frequency of the low frequency driving mode is 1 Hz, fifty-nine continuous holding frames are disposed between two adjacent writing frames.

For example, when the frequency of the normal driving mode is 60 Hz and the frequency of the low frequency driving mode is 10 Hz, the low frequency driving mode includes ten writing frame and fifty holding frames in a second. When the frequency of the normal driving mode is 60 Hz and the frequency of the low frequency driving mode is 10 Hz, five continuous holding frames are disposed between two adjacent writing frames.

In the present example embodiment, the second data writing gate signal GWN and the data initialization gate signal GI may have a first frequency in the low frequency driving mode. The first frequency may be the frequency of the low frequency driving mode. In contrast, the first data writing gate signal GWP, the emission signal EM and the organic light emitting element initialization gate signal GB may have a second frequency greater than the first frequency. The second frequency may be the normal frequency of the normal driving mode.

The low driving frequency 240 in FIG. 3 may be applied to the structure of the display panel of the present example embodiment. In addition, the low driving frequency 240A in FIG. 11 may be applied to the structure of the display panel of the present example embodiment.

According to the present example embodiment, the frame rate FR is determined according to the image displayed on the display panel 100 so that the power consumption of the display apparatus may be reduced. In addition, the frame rate FR is determined using the flicker value of the segment of the image displayed on the display panel 100 so that the flicker of the image may be prevented and the display quality of the display panel 100 may be improved. In addition, the flicker values of the segments are compensated using the flicker values of the adjacent segments so that the display quality of the display panel 100 may be further improved.

According to the present example embodiment, a power consumption of the display apparatus may be reduced and a display quality of the display panel may be enhanced.

The foregoing is illustrative of the present inventive concept and is not to be construed as limiting thereof. Although a few example embodiments of the present inventive concept have been described, those skilled in the art will readily appreciate that many modifications are possible in the example embodiments without materially departing from the novel teachings and advantages of the present inventive concept. Accordingly, all such modifications are intended to be included within the scope of the present inventive concept as defined in the claims. In the claims, means-plus-function clauses are intended to cover the structures described herein as performing the recited function and not only structural equivalents but also equivalent structures. Therefore, the foregoing is illustrative of the present inventive concept and is not to be construed as limited to the specific example embodiments disclosed, and that modifications to the disclosed example embodiments, as well as other example embodiments, are intended to be included within the scope of the appended claims. The present inventive concept is defined by the following claims, with equivalents of the claims to be included therein.

What is claimed is:

1. A method of driving a display panel, the method comprising:

generating a flicker value of a segment of a plurality of segments of an input image;

compensating the flicker value of the segment based on a segment size, the flicker value of the segment, and flicker values of neighboring segments positioned around the segment;

determining a frame rate of the display panel based on the flicker value of the segment; and driving the display panel in the frame rate, wherein compensating the flicker value comprises:

determining not to compensate the flicker value of the segment when the segment size is equal to or greater than a compensation threshold; and determining to compensate the flicker value of the segment when the segment size is less than the compensation threshold.

2. The method of claim 1, further comprising:

determining a compensation size, wherein the compensation size represents a number of a flicker value of a compensation target segment and flicker values of segments adjacent to the compensation target segment; and wherein the compensation size is used for compensation of the compensation target segment when the segment size is less than the compensation threshold.

3. The method of claim 2, wherein the compensation size is determined such that a multiplication of the segment size and the compensation size is equal to or greater than the compensation threshold.

4. The method of claim 3, wherein the compensation size is determined as a minimum integer satisfying that the multiplication of the segment size and the compensation size is equal to or greater than the compensation threshold.

5. The method of claim 2, wherein determining the compensation size comprises:

determining a first compensation size representing a number of the flicker value of the compensation target segment and the flicker values of the segments adjacent to the compensation target segment in a first direction; and determining a second compensation size representing a number of the flicker value of the compensation target segment and the flicker values of the segments adjacent to the compensation target segment in a second direction different from the first direction;

wherein the first compensation size and the second compensation size are each used for compensation of the compensation target segment.

6. The method of claim 1, further comprising determining whether the input image represents a static image or a video image, wherein the frame rate of the display panel is determined based on the flicker value of the segment when the input image represents the static image.

7. The method of claim 1, wherein generating the flicker value of the segment comprises:

converting luminances of pixels into flicker values of the pixels; and operating the flicker values of the pixels in the segments.

8. The method of claim 7, wherein operating the flicker values of the pixels in the segments comprises summing the flicker values of the pixels in the segments.

9. The method of claim 7, wherein operating the flicker values of the pixels in the segments comprises:

setting weights of the pixels based on positions of the pixels; and operating a weighted sum of the flicker values of the pixels using the weights of the pixels.

10. The method of claim 1, wherein determining the frame rate of the display panel comprises comparing a maximum value of the flicker values of the segments to a threshold.

11. The method of claim 1, wherein determining the frame rate of the display panel comprises comparing an average of flicker values of segments that is greater than a predetermined flicker value to a threshold.

12. The method of claim 1, wherein the display panel includes a pixel and a plurality of gate lines connected to the pixel, wherein a plurality of gate signals is respectively applied to the plurality of gate lines, and wherein at least one of the plurality of gate signals is applied to the corresponding gate line in the frame rate.

13. A method of driving a display panel, the method comprising:

generating a flicker value of a segment of a plurality of segments of an input image;

compensating the flicker value of the segment based on a segment size, the flicker value of the segment, and flicker values of neighboring segments positioned around the segment;

determining a frame rate of the display panel based on the flicker value of the segment;

driving the display panel in the frame rate; and determining a compensation size, wherein the compensation size is determined by dividing a compensation threshold by the segment size, wherein determining whether or not to compensate the flicker value of the segment comprises:

determining not to compensate the flicker value of the segment when the compensation size is equal to or less than 1; and determining to compensate the flicker value of the segment when the compensation size is greater than 1.

14. The method of claim 13, wherein determining the compensation size comprises:

determining a first compensation size representing a number of a flicker value of a compensation target segment and the flicker values of the segments adjacent to the compensation target segment in a first direction; and determining a second compensation size representing a number of the flicker value of the compensation target segment and the flicker values of the segments adjacent to the compensation target segment in a second direction different from the first direction;

wherein the first compensation size and the second compensation size are used for compensation of the compensation target segment.

15. A display apparatus comprising:

a display panel configured to display an image;

a low frequency driver connected to the display panel and configured to generate a flicker value of a segment of a plurality of segments of an input image, to compensate the flicker value of the segment depending on a segment size, and to determine a frame rate of the display panel based on the flicker value of the segment; and a data driver connected to the display panel and configured to output a data voltage to the display panel, wherein the low frequency driver is configured to determine not to compensate the flicker value of the segment when the segment size is equal to or greater than a compensation threshold; and wherein the low frequency driver is configured to determine to compensate the flicker value of the segment when the segment size is less than the compensation threshold.

16. The display apparatus of claim 15, wherein the low frequency driver is configured to determine a compensation size, the compensation size representing a number of a flicker value of a compensation target segment and flicker values of segments adjacent to the compensation target segment, the compensation size used for compensation of the compensation target segment when the segment size is less than the compensation threshold.

17. The display apparatus of claim 16, wherein the compensation size is determined such that a multiplication of the segment size and the compensation size is equal to or greater than the compensation threshold.

18. The display apparatus of claim 15, wherein the low frequency driver is configured to determine a compensation size;

wherein the compensation size is determined based on a number of a flicker value of a compensation target segment and flicker values of segments adjacent to the compensation target segment, the compensation size used for compensation of the compensation target segment;

wherein the compensation size is determined by dividing the compensation threshold by the segment size;

wherein the low frequency driver is configured to determine not to compensate the flicker value of the segment when the segment size is equal to or less than 1; and wherein the low frequency driver is configured to determine to compensate the flicker value of the segment when the segment size is greater than 1.

19. The display apparatus of claim 15, wherein the low frequency driver comprises a static image determiner configured to determine whether the input image represents a static image or a video image, and wherein the low frequency driver is configured to determine the frame rate of the display panel based on the flicker value of the segment when the input image represents the static image.

20. The display apparatus of claim 15, wherein the display panel includes a pixel and a plurality of gate lines connected to the pixel, wherein a plurality of gate signals is respectively applied to the plurality of gate lines, and wherein at least one of the plurality of gate signals is applied to the corresponding gate line in the frame rate.

* * * * *